US008225968B2

(12) United States Patent
Schaupp et al.

(10) Patent No.: US 8,225,968 B2
(45) Date of Patent: Jul. 24, 2012

(54) SEAL SYSTEM FOR GEAR PUMPS

(75) Inventors: John F. Schaupp, Sylvania, OH (US); Martin J. Selmek, Temperance, MI (US)

(73) Assignee: Illinois Tool Works Inc., Glenview, IL (US)

( * ) Notice: Subject to any disclaimer, the term of this patent is extended or adjusted under 35 U.S.C. 154(b) by 528 days.

(21) Appl. No.: 12/464,378

(22) Filed: May 12, 2009

(65) Prior Publication Data

US 2010/0288793 A1 Nov. 18, 2010

(51) Int. Cl.

| | |
|---|---|
| ***F04C 2/00*** | (2006.01) |
| ***F04C 15/00*** | (2006.01) |
| ***F04C 27/00*** | (2006.01) |
| ***G01F 11/00*** | (2006.01) |
| ***F16J 15/32*** | (2006.01) |

(52) U.S. Cl. ..... 222/333; 222/148; 277/549; 277/562; 418/104

(58) Field of Classification Search ..... 222/148, 222/251, 333; 277/549, 559, 562; 418/91, 418/102, 104; 239/104, 329, 690; 417/410.1
See application file for complete search history.

(56) References Cited

U.S. PATENT DOCUMENTS

| | | | |
|---|---|---|---|
| 3,169,882 | A | 2/1965 | Juvinall et al. |
| 3,169,883 | A | 2/1965 | Juvinall |
| 3,940,061 | A | 2/1976 | Gimple et al. |
| 3,964,683 | A | 6/1976 | Gimple |
| 3,990,609 | A | 11/1976 | Grant |
| 4,001,935 | A | 1/1977 | Krohn et al. |
| 4,002,777 | A | 1/1977 | Juvinall et al. |
| 4,020,393 | A | 4/1977 | Porter |
| 4,030,857 | A | 6/1977 | Smith, Jr. |
| 4,037,561 | A | 7/1977 | LaFave et al. |
| 4,066,041 | A | 1/1978 | Buschor et al. |
| 4,075,677 | A | 2/1978 | Bentley |
| 4,081,904 | A | 4/1978 | Krohn et al. |
| 4,105,164 | A | 8/1978 | Lau et al. |
| 4,114,564 | A | 9/1978 | Probst |
| 4,116,364 | A | 9/1978 | Culbertson et al. |
| 4,133,483 | A | 1/1979 | Henderson |
| D252,097 | S | 6/1979 | Probst et al. |

(Continued)

FOREIGN PATENT DOCUMENTS

DE 195 15 094 A1 11/1995

(Continued)

OTHER PUBLICATIONS

International search report from PCT/US2010/029906 dated Mar. 30, 2011, 12 pages.

(Continued)

*Primary Examiner* — Darren W Gorman
(74) *Attorney, Agent, or Firm* — Barnes & Thornburg LLP

(57) ABSTRACT

A pump adapted for coupling in a fluid circuit between a source of coating material and a dispensing device. The pump includes an operating member which extends through a pump housing to a location adjacent the fluid circuit. The passage of the operating member to a location adjacent the fluid circuit includes a seal system permit operation of the pump while reducing the likelihood of leakage of the coating material from the circuit out of the housing along the operating member. The seal system includes at least first and second seals defining between them a flushable seal chamber facing a pump chamber containing the coating material being pumped.

10 Claims, 6 Drawing Sheets

U.S. PATENT DOCUMENTS 4,165,022 A 8/1979 Bentley et al.
4,169,545 A 10/1979 Decker
4,171,100 A 10/1979 Benedek et al.
4,174,070 A 11/1979 Lau et al.
4,174,071 A 11/1979 Lau et al.
4,187,527 A 2/1980 Bentley
4,214,709 A 7/1980 Scull et al.
4,248,386 A 2/1981 Morle
4,266,721 A 5/1981 Sickles
4,285,446 A 8/1981 Rapp et al.
4,289,278 A 9/1981 Itoh
4,324,812 A 4/1982 Bentley
4,331,298 A 5/1982 Bentley et al.
RE30,968 E 6/1982 Grant
4,361,283 A 11/1982 Hetherington et al.
D270,179 S 8/1983 Grime
D270,180 S 8/1983 Grime
D270,367 S 8/1983 Grime
D270,368 S 8/1983 Grime
4,400,147 A 8/1983 Springer et al.
4,401,268 A 8/1983 Pomponi, Jr.
4,433,812 A 2/1984 Grime
4,437,614 A 3/1984 Garcowski
4,453,670 A 6/1984 Sirovy
4,481,557 A 11/1984 Woodruff
4,483,483 A 11/1984 Grime
4,485,427 A 11/1984 Woodruff et al.
4,513,913 A 4/1985 Smith
4,515,512 A 5/1985 Hertell et al.
4,529,131 A 7/1985 Rutz
4,534,717 A 8/1985 McCabe et al.
4,537,357 A 8/1985 Culbertson et al.
4,572,438 A 2/1986 Traylor
4,606,501 A 8/1986 Bate et al.
4,613,082 A 9/1986 Gimple et al.
D287,266 S 12/1986 Knetl et al.
4,702,420 A 10/1987 Rath
4,745,520 A 5/1988 Hughey
4,747,546 A 5/1988 Talacko
4,759,502 A 7/1988 Pomponi, Jr. et al.
4,760,962 A 8/1988 Wheeler
4,770,117 A 9/1988 Hetherington et al.
4,819,879 A 4/1989 Sharpless et al.
4,844,342 A 7/1989 Foley
D303,139 S 8/1989 Morgan
D305,057 S 12/1989 Morgan
D305,452 S 1/1990 Morgan
D305,453 S 1/1990 Morgan
4,911,367 A 3/1990 Lasley
4,921,172 A 5/1990 Belmain et al.
4,927,079 A 5/1990 Smith
4,934,603 A 6/1990 Lasley
4,934,607 A 6/1990 Lasley
4,993,645 A 2/1991 Buschor
5,022,590 A 6/1991 Buschor
D318,712 S 7/1991 Buschor
5,039,019 A 8/1991 Weinstein et al.
5,054,687 A 10/1991 Burns et al.
5,064,119 A 11/1991 Mellette
5,074,466 A 12/1991 Santiago
5,090,623 A 2/1992 Burns et al.
D325,241 S 4/1992 Buschor
5,118,080 A 6/1992 Hartmann
5,119,992 A 6/1992 Grime
5,159,244 A 10/1992 Poulson
5,178,330 A 1/1993 Rodgers
5,180,104 A 1/1993 Mellette
5,180,297 A 1/1993 Hansen et al.
5,209,365 A 5/1993 Wood
5,209,405 A 5/1993 Robinson et al.
5,228,842 A * 7/1993 Guebeli et al. ..... 417/360
5,236,129 A 8/1993 Grime et al.
5,284,299 A 2/1994 Medlock
5,284,301 A 2/1994 Kieffer
5,289,974 A 3/1994 Grime et al.
5,299,740 A 4/1994 Bert
5,303,865 A 4/1994 Bert
5,330,108 A 7/1994 Grime et al.
5,332,156 A 7/1994 Wheeler
5,332,159 A 7/1994 Grime et al.
D349,559 S 8/1994 Vanderhoef et al.
5,351,887 A 10/1994 Heterington et al.
5,395,054 A 3/1995 Wheeler
5,400,971 A 3/1995 Maugans et al.
5,553,788 A 9/1996 Del Gaone et al.
5,582,350 A 12/1996 Kosmyna et al.
5,618,001 A 4/1997 Del Gaone et al.
5,632,816 A 5/1997 Allen et al.
5,639,027 A 6/1997 Fritz
5,704,977 A 1/1998 Baumann et al.
RE35,769 E 4/1998 Grime et al.
5,746,831 A 5/1998 Allen et al.
5,787,928 A 8/1998 Allen et al.
5,803,313 A 9/1998 Flatt et al.
5,829,679 A 11/1998 Strong
5,836,517 A 11/1998 Burns et al.
5,944,045 A 8/1999 Allen et al.
RE36,378 E 11/1999 Mellette
5,978,244 A 11/1999 Hughey
6,144,570 A 11/2000 Hughey
6,179,223 B1 1/2001 Sherman et al.
6,183,231 B1 2/2001 Van Norman
6,189,809 B1 2/2001 Schwebemeyer
6,276,616 B1 8/2001 Jenkins
6,402,058 B2 6/2002 Kaneko et al.
6,423,142 B1 7/2002 Hughey
6,460,787 B1 10/2002 Hartle et al.
6,562,137 B2 5/2003 Hughey
6,572,029 B1 6/2003 Holt
6,585,481 B1 7/2003 Sandkleiva
6,669,112 B2 12/2003 Reetz, III et al.
6,679,193 B2 1/2004 Shutic et al.
6,698,670 B1 3/2004 Gosis et al.
6,706,641 B2 3/2004 Worm et al.
6,712,292 B1 3/2004 Gosis et al.
6,726,065 B2 4/2004 Sanders
6,730,612 B2 5/2004 Worm et al.
RE38,526 E 6/2004 Hansinger et al.
6,758,425 B2 7/2004 Michael
6,776,362 B2 8/2004 Kawamoto et al.
6,790,285 B2 9/2004 Matsumoto
6,796,519 B1 9/2004 Knobbe et al.
6,817,553 B2 11/2004 Steur
6,854,672 B2 2/2005 Allen
6,877,681 B2 4/2005 Hartle et al.
6,916,023 B2 7/2005 Alexander et al.
6,929,698 B2 8/2005 Shutic et al.
6,951,309 B2 10/2005 Buschor et al.
6,955,724 B2 10/2005 Dankert
7,128,277 B2 10/2006 Schaupp
7,143,963 B2 12/2006 Tani et al.
7,166,164 B2 1/2007 Shutic et al.
7,217,442 B2 5/2007 Wilt et al.
7,247,205 B2 7/2007 Shutic et al.
7,292,322 B2 11/2007 Borodirsky et al.
7,296,759 B2 11/2007 Alexander et al.
7,296,760 B2 11/2007 Alexander et al.
2002/0170580 A1* 11/2002 Clifford et al. ..... 134/36
2003/0006322 A1 1/2003 Hartle et al.
2004/0007821 A1* 1/2004 Ramsay ..... 277/353
2005/0087068 A1 4/2005 Nagai et al.
2005/0093246 A1* 5/2005 Dietle et al. ..... 277/549
2005/0253340 A1* 11/2005 Ramsay ..... 277/559
2006/0081729 A1 4/2006 Nagai
2006/0283386 A1 12/2006 Alexander et al.
2007/0205561 A1 9/2007 Emoto et al.

FOREIGN PATENT DOCUMENTS

EP 0 412 634 A2 2/1991
EP 0 643 223 B1 3/1995
FR 2 260 715 A1 9/1975
WO 01/85353 A1 11/2001
WO 2005/014177 A1 2/2005
WO 2008/135326 A1 11/2008

OTHER PUBLICATIONS

"M90 Handguns", Service Manual, Ransburg, 2005, 48 pages.

"REA-70 and REA-70L Electrostatic Spray Guns Dual Atomization Technology", Service Manual, Ransburg 41 pages.

"Automatic R-E-A III Electrostatic Spray or R-E-A III-L Electrostatic HVLP Spray", ITW Ransburg Electrostatic Systems, 1996, 2 pages.

"REA-IV and REA-IVL Delta Electrostatic Spray Guns, Dual Atomization Technology", Service Manual, ITW Ransburg Electrostatic Systems, 1998, 27 pages, Addendum, 2005, 4 pages.

"REA-90A and REA-90LA Automatic Electrostatic Spray Guns", Service Maunal, ITW Ransburg, 2006, 44 pages.

* cited by examiner

SEAL SYSTEM FOR GEAR PUMPS

FIELD OF THE INVENTION

This invention relates to sealing systems for pumps for pumping liquids. It is disclosed in the context of a shaft or operating rod seal for a positive displacement pump, specifically a gear pump, for pumping coating material in a coating operation. However, it is believed to be useful in other applications as well.

BACKGROUND OF THE INVENTION

Cup seals are known. There are, for example, the apparatus illustrated and described in U.S. Pat. Nos. 6,730,612; 6,706,641; 5,944,045; 5,787,928; 5,746,831; 5,704,977; 5,632,816. Gear pumps are known. There are, for example, the apparatus illustrated and described in U.S. Pat. Nos. 6,726,065; 6,183,231; 4,534,717; 4,400,147. The disclosures of these references are hereby incorporated herein by reference. This listing is not intended as a representation that a complete search of all relevant prior art has been conducted, or that no better references than those listed exist. Nor should any such representation be inferred.

DISCLOSURE OF THE INVENTION

According to an aspect of the invention, a pump adapted for coupling in a fluid circuit between a source of coating material and a dispensing device includes an operating member which extends through a pump housing and adjacent the fluid circuit. The passage of the operating member adjacent the fluid circuit includes a seal system to permit operation of the pump while reducing the likelihood of leakage of the coating material from the circuit out of the housing along the operating member. The seal system includes at least first and second seals defining between them a seal chamber facing a pump chamber containing the coating material being pumped, and a fluid circuit through which a fluid medium is provided under pressure to the seal chamber.

According to another aspect of the invention, a coating material dispensing apparatus includes a source of coating material and a dispensing device. A pump is coupled in a fluid circuit between the source of coating material and the dispensing device. The pump includes a pump housing. An operating member extends through the pump housing to a location adjacent the fluid circuit. The passage of the operating member through the pump housing to a location adjacent the fluid circuit includes a seal system to permit operation of the pump while reducing the likelihood of leakage of the coating material from the circuit out of the housing along the operating member. The seal system includes at least first and second seals defining between them a seal chamber facing a pump chamber containing the coating material being pumped, and a fluid circuit through which a fluid medium is provided under pressure to the seal chamber.

Illustratively according to these aspects, the first seal has a rearward face and the second seal includes opposed lips defining between them a groove. The lips of the second seal and the rearward face of the first seal define between them the seal chamber.

Further illustratively according to these aspects, a lip of the second seal is sufficiently flexible that the fluid medium may be introduced past the lip into the seal chamber.

Further illustratively according to these aspects, the apparatus includes a motor coupled to the operating member for operating the pump.

Illustratively according to these aspects, the motor comprises a rotary electric motor.

BRIEF DESCRIPTION OF THE DRAWINGS

The invention may best be understood by referring to the following detailed description and accompanying drawings which illustrate the invention. In the drawings.

DETAILED DESCRIPTIONS OF ILLUSTRATIVE EMBODIMENTS

Figure 1:
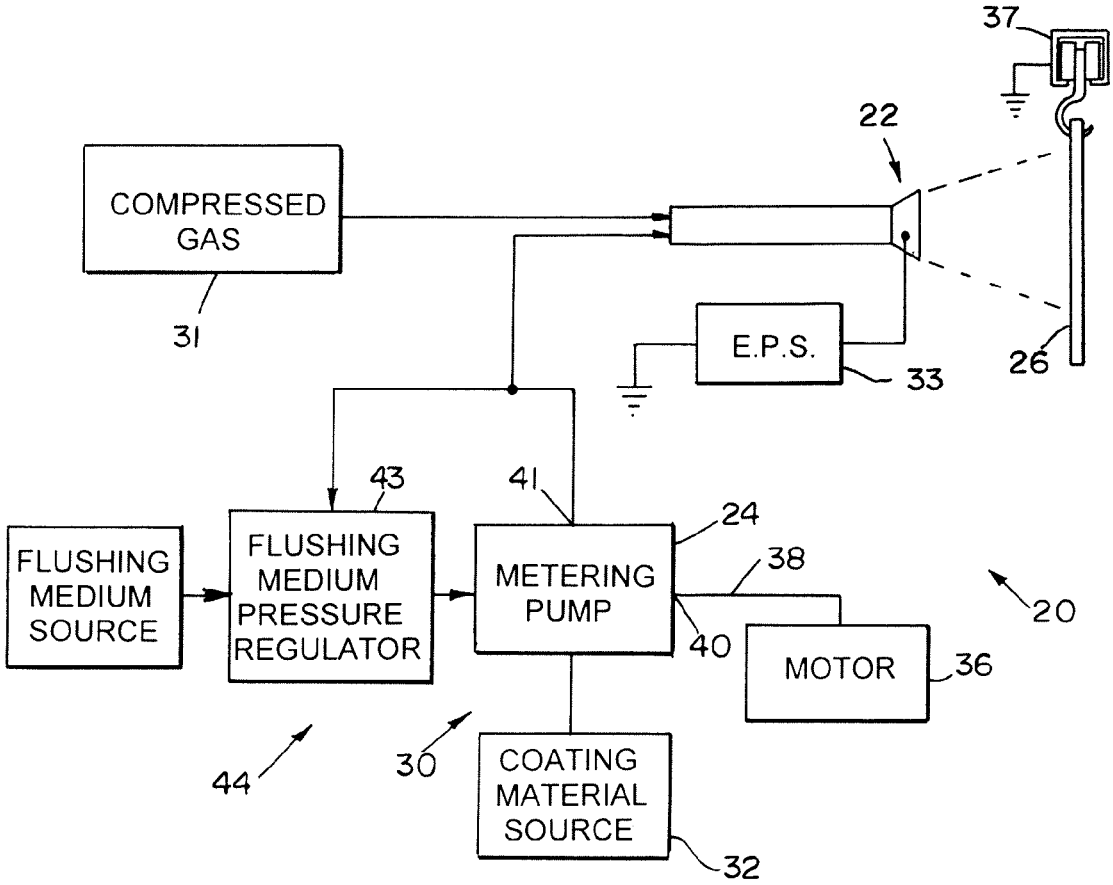
FIG. 1 illustrates diagrammatically a coating material dispensing, atomizing and coating operation.

Referring first to FIG. 1, a liquid coating system 20 comprises a dispensing device 22, hereinafter sometimes an atomizer, and a supply pump 24. The atomizer 22 can be any of the conventional, readily available types of manual or automatic, hydraulic (or airless), air-assisted airless, or air atomizers, either electrostatically aided or non-electrostatic. Illustrative of these types of atomizers are the atomizers illustrated and described in the following listed U.S. patents and published applications: 2006/0081729; 2003/0006322; U.S. Pat. Nos. 7,296,760; 7,296,759; 7,292,322; 7,247,205; 7,217,442; 7,166,164; 7,143,963; 7,128,277; 6,955,724; 6,951,309; 6,929,698; 6,916,023; 6,877,681; 6,854,672; 6,817,553; 6,796,519; 6,790,285; 6,776,362; 6,758,425; RE38,526; 6,712,292; 6,698,670; 6,679,193; 6,669,112; 6,572,029; 6,460,787; 6,402,058; U.S. Pat. No. RE36,378; 6,276,616; 6,189,809; 6,179,223; 5,836,517; 5,829,679; 5,803,313; U.S. Pat. No. RE35,769; 5,639,027; 5,618,001; 5,582,350; 5,553,788; 5,400,971; 5,395,054; D349,559; 5,351,887; 5,332,159; 5,332,156; 5,330,108; 5,303,865; 5,299,740; 5,289,974; 5,284,301; 5,284,299; 5,236,129; 5,209,405; 5,209,365; 5,178,330; 5,119,992; 5,118,080; 5,180,104; D325,241; 5,090,623; 5,074,466; 5,064,119; 5,054,687; 5,039,019; D318,712; 5,022,590; 4,993,645; 4,934,607; 4,934,603; 4,927,079; 4,921,172; 4,911,367; D305,453; D305,452; D305,057; D303,139; 4,844,342; 4,819,879; 4,770,117; 4,760,962; 4,759,502; 4,747,546; 4,702,420; 4,613,082; 4,606,501; 4,572,438; D287,266; 4,537,357; 4,529,131; 4,513,913; 4,483,483; 4,453,670; 4,437,614; 4,433,812; 4,401,268; 4,361,283; D270,368; D270,367; D270,180; D270,179; RE30,968; 4,331,298; 4,289,278; 4,285,446; 4,266,721; 4,248,386; 4,214,709; 4,174,071; 4,174,070; 4,171,100; 4,169,545; 4,165,022; D252,097; 4,133,483; 4,116,364; 4,114,564; 4,105,164; 4,081,904; 4,066,041; 4,037,561; 4,030,857; 4,020,393; 4,002,777; 4,001,935; 3,990,609; 3,964,683; 3,940,061; 3,169,883; and, 3,169,882. There are also the disclosures of WO 2005/014177 and WO 01/85353. There are also the Ransburg model REA 3, REA 4, REA 70, REA 90, REM and M-90 guns, all available from ITW Ransburg, 320 Phillips Avenue, Toledo, Ohio, 43612-1493.

The disclosures of these references are hereby incorporated herein by reference. The above listing is not intended to be a representation that a complete search of all relevant art has been made, or that no more pertinent art than that listed exists, or that the listed art is material to patentability. Nor should any such representation be inferred.

The illustrated atomizer 22 atomizes and dispenses electrostatically charged coating material particles, such as, for example, particles of liquid paint, to coat a substrate 26, hereinafter sometimes a target. The coating material generally is transported through an intervening fluid circuit 30 from a source 32 of such coating material to the dispensing device 22, for example, by pressurizing the source 32, by gravity, and/or by mechanically pumping/metering the coating material in the circuit 30 by a mechanical pump 24, for example, a positive displacement pump, inserted at a convenient point in the circuit 30.

The coating material is delivered to the atomizer 22 where the coating material is atomized into a cloud, the cloud is shaped and directed toward the target by a flow of compressed gas (for example, air) from a compressed gas source 31, and/or by electrostatically charging the coating material during atomization from a source 33 of electrostatic potential, and maintaining the target 26 at or near ground potential (as by maintaining a conveyor 37 by which the target 26 is conveyed past the atomizer 22 at or near ground potential and maintaining low electrical resistance between the target 26 and the conveyor 37. Source 33 can be any of a number of known power supplies, such as the supplies illustrated and described in any of U.S. Pat. Nos. 6,562,137; 6,423,142; 6,144,570; 5,978,244; 5,159,544; 4,745,520; 4,485,427; 4,481,557; 4,331,298; 4,324,812; 4,187,527; 4,165,022; 4,075,677, and published U.S. patent application 2006-0283386-A1. The disclosures of these references are hereby incorporated herein by reference. This listing is not intended as a representation that a complete search of all relevant prior art has been conducted, or that no better references than those listed exist. Nor should any such representation be inferred.

If a plural component coating material is being dispensed, there typically will be either (a) non-contact fluid flow meter(s) or (a) mechanical device(s) in the fluid circuit 30 between the pump(s) 24 and the atomizer 22 to insure delivery of appropriate ratios of the plural components to the atomizer 22.

Typically, pumps 24 can be driven by pneumatic or electric motors 36 that require passage of, for example, a pump drive shaft 38 or operating rod into the fluid path. The motor 36 may rotate or be a linear motor, such as, for example, a diaphragm-type pump. The passage of the pump drive shaft 38, operating rod or the like into the fluid path needs to be sealed 40 to permit the circuit 30 including pump 24 to be pressurized and to permit operation of the pump 24 without leakage of the coating material from the circuit 30.

Such fluid seals come in a variety of shapes and materials to impart enough surface pressure on the drive shaft 38, operating rod or the like to prevent the fluid from traveling under the seal 40. Seal 40 life depends, among other factors, on this surface pressure, the lubricity of the material(s) being pumped, particle characteristics of the material(s) being pumped, and velocity difference between the seal 40 and drive shaft 38, operating rod or the like. Abrasion caused by friction erodes the contacting surface(s) of either the seal 40 or the drive shaft 38, operating rod or the like, or both. As the seal 40 fails, either the seal 40 or the drive shaft 38, operating rod or the like, or both lose enough material to reduce the sealing surface pressure and establish a path for the coating material to leak between them.

The disclosed fluid seal system 40 extends fluid seal life by providing within the seal system 40 a flushing zone 42. The flushing zone 42 completes a flow path or circuit 44 for a flushing medium, illustratively, a solvent for the pumped coating material. This permits flushing medium to wash through the seal system 40 and, optionally, to leak from it. The flushing zone 42 is intermittently or continuously charged with clean flushing medium. Clean flushing medium introduced intermittently resides in the flushing zone 42 until the next time when clean flushing medium is introduced. The clean flushing medium introduced into the seal system 40 helps reduce the likelihood of leakage of coating material through the seal system 40 by helping equalize pressure between the seal system 40 and the coating material circuit 30. The clean flushing medium can also dilute any coating material that escapes through the seal system 40 by adhering to the operating member 38.

The flushing zone 42 within the seal system 40 permits clean flushing medium to clean a zone 42 within the seal system 40. The clean flushing medium flushes coating material from flushing zone 42. Particulates in the coating material which otherwise would increase surface friction and possible ultimately failure of the seal system 40 are thus flushed from it. By limiting the exposure of the seal system 40 to such particulates, the seal system 40's robustness is increased. This increase tends to increase mean time to failure and reduce maintenance outages. The seal system 40 may be of particular utility in pumps located in, for example, robotic arms and other locations where access is limited or difficult.

With the disclosed seal system 40, the clean flushing medium can also flush from the seal system 40 into the pumped coating material, dislodging from the operating member 38 any particulates that might otherwise abrade the seal 40, the operating member 38 or both. This flushing will tend to increase the seal system 40 life, which again tends to increase mean time to failure and reduce maintenance outages.

Filling the seal system 40 with clean flushing medium permits the flushing medium to be pressurized to match the pressure of the coating material being sealed, protecting the seal system 40 somewhat against pressure differential-related failure of the seal system 40. The pressure of the clean flushing medium supplied to the pump 24 can be controlled from the output pressure at the output port 41 of the pump 24 using a pressure regulator 43 of known type. Illustrative are the pressure regulators illustrated and described in, for example, U.S. Pat. No. 4,828,218 and references cited therein. The disclosures of these references are hereby incorporated herein by reference. This listing is not intended as a representation that a complete search of all relevant prior art has been conducted, or that no better references than those listed exist. Nor should any such representation be inferred.

Figure 2:
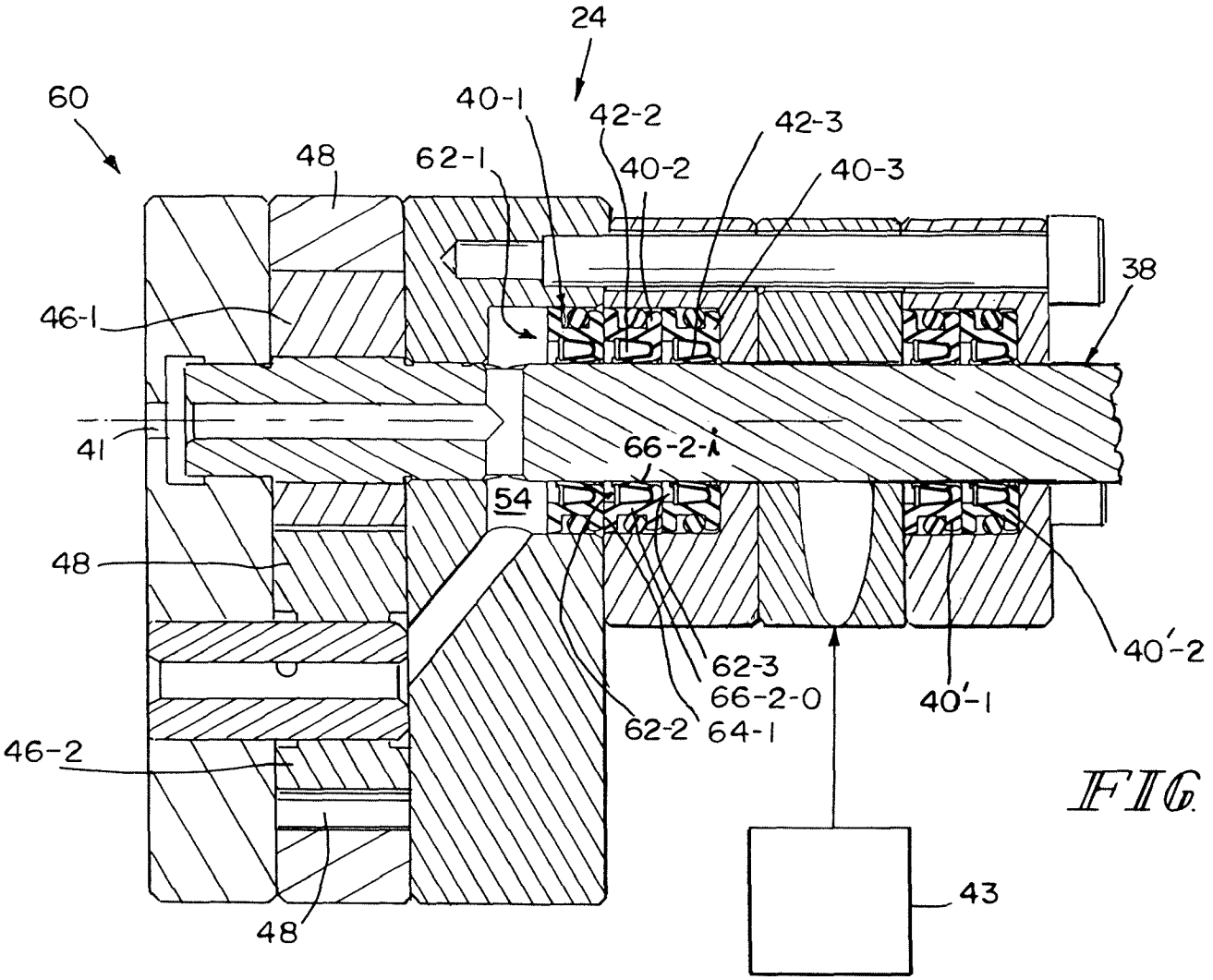
FIG. 2 illustrates a longitudinal sectional view of a detail of the apparatus illustrated in FIG. 1.
Figure 3:
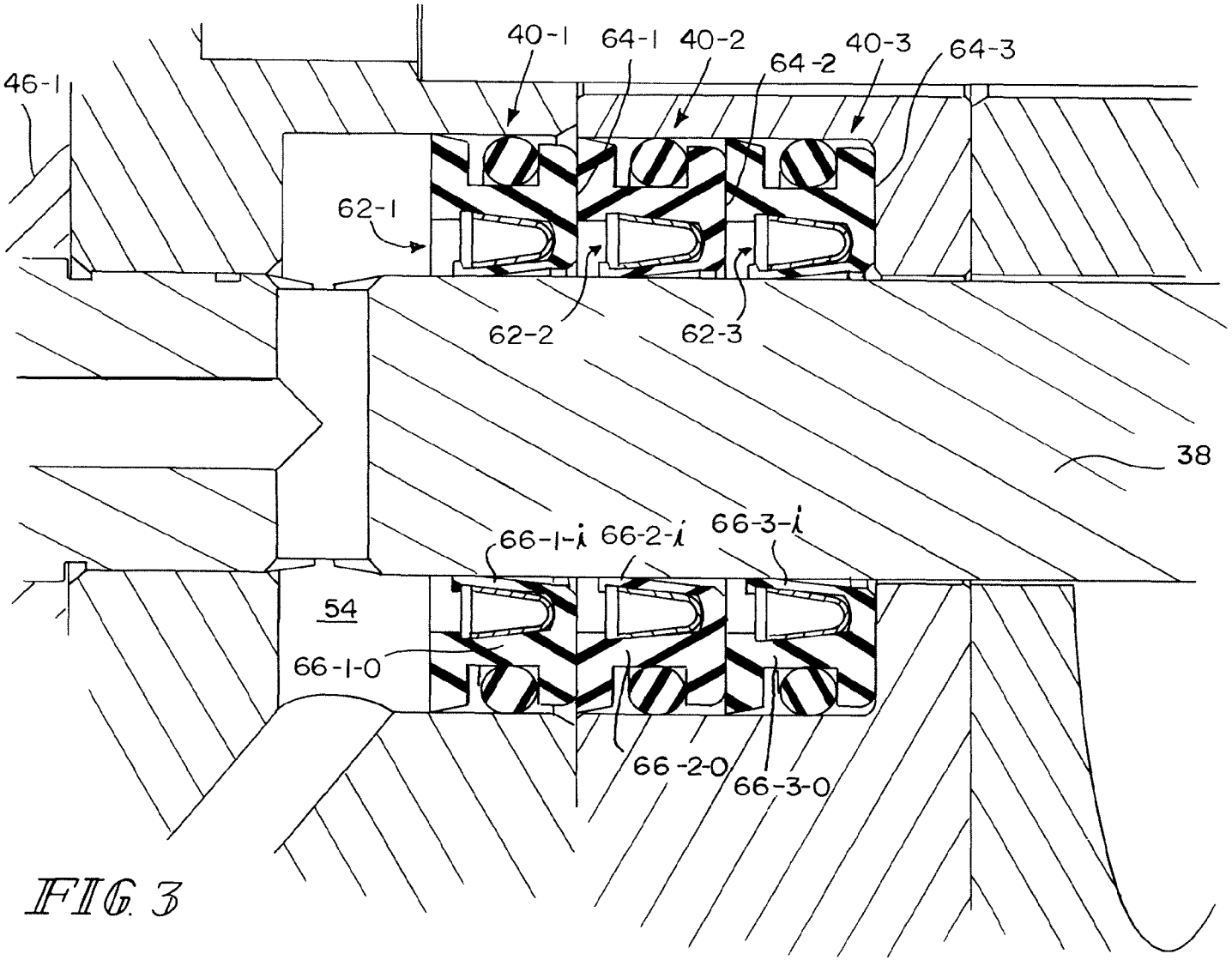
FIG. 3 illustrates a much-enlarged view of a portion of FIG. 2.
Figure 4:
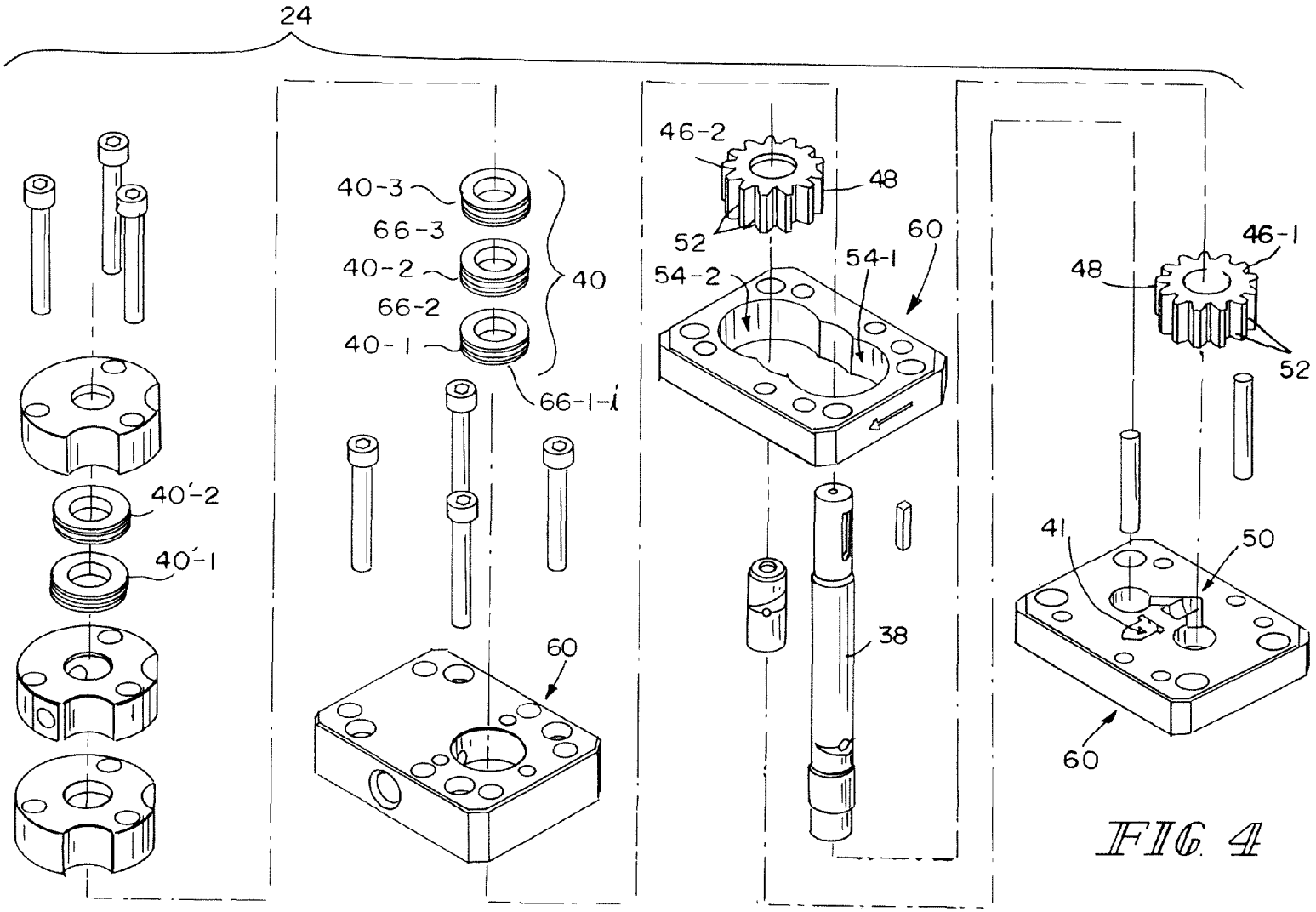
FIG. 4 illustrates an exploded perspective view of the apparatus illustrated in FIGS. 2-3.

Turning now to FIGS. 2-4, an illustrative positive displacement pump 24, a gear pump, includes gears 46-1, 46-2 having meshing teeth 48 from between which coating material is continuously squeezed by their meshing, resulting in delivery of a known amount of coating material for each rotation of the gears 46-1, 46-2 regardless of pressure in the coating material circuit 30 and the like. Typically, the coating material is delivered through the circuit 30 from a source 32 by, for example, gravity feed, pressurizing the source with a gas or mixture of gases such as compressed air (sometimes referred to herein as "factory air"), etc. The thus-delivered coating material flows from an inlet port 50, filling the spaces 52 between the teeth 48 of each gear 46-1, 46-2, is carried around the chamber 54-1, 54-2 housing each gear 46-1, 46-2, respectively, by the teeth 48 of the gear 46-1, 46-2, and is squeezed from between the teeth 48 of each gear 46-1, 46-2 into outlet port 41 as the teeth 48 of gears 46-1, 46-2 reengage. The coating material squeezed from between the teeth 48 of gears

46-1, 46-2 continues from the outlet port 41 through the circuit 30 and is delivered to the dispensing device 22 for atomization and dispensing toward a target 26 to be coated by the atomized coating material.

The gears 46-1, 46-2 are driven to rotate by a drive shaft 38 which extends through the pump 24 housing 60. One 46-1 of the gears 46-1, 46-2 is mounted for rotation by the drive shaft 38. The other gear 46-2 rotates owing to its engagement with the first gear 46-1. To reduce the likelihood of leakage of coating material along the drive shaft 38, a seal system 40 is provided between the housing 60 and the drive shaft 38. The seal system 40 includes at least two seals 40-1, 40-2, . . . **40-*n*, each with its cup- or groove-shaped surface 62-1, 62-2, . . . 62-*n* facing the chamber 54-1, 54-2 containing the coating material being pumped. The cup seals 40-1, 40-2, . . . 40-*n* are stacked, one upon the other, thus defining (a) seal chamber(s) 42-2, . . . 42-*n* between them. The forwardmost seal 40-1, that is, the one closest to the coating material chamber 54-1, 54-2 has a rearward face 64-1 which cooperates with the lips 66-2 of the next adjacent seal 40-2 in the stack to define the seal chamber 42-2. At least one 66-2-*i*, 66-3-*i*, . . . 66-*n*-*i* of the lips 66-2, 66-3, . . . 66-*n* of each of the adjacent seals 40-2, 40-3, . . . 40-*n* in the stack is sufficiently flexible that a flushing medium under pressure may be introduced from flushing medium circuit 44 down the shaft 38 past the lips 66-2 of the seal 40-2 into the passageway 42-2. The seals 40-2, 40-3, . . . 40-*n* may be chosen such that this pressure approximates the pressure to be maintained on the coating material in the outlet port 41. By so doing, the pressure drop across the forwardmost seal 40-1 from inlet port 50, coating material pumping chamber 54-1, 54-2 and/or outlet port 41 to the seal chamber 42-2 is minimized. This tends to reduce stress on the forwardmost seal 40-1 and the likelihood of material flow across the forwardmost seal 40-1 in either direction, either of coating material from the inlet port 50, coating material pumping chamber 54-1, 54-2 and/or outlet port 41 into the seal chamber 42-2 or of flushing medium from the seal chamber 42-2 into the inlet port 50, coating material pumping chamber 54-1, 54-2 and/or outlet port 41. The stacking of multiple such seals 40-1, 40-2, . . . 40-*n* also helps to distribute the stress across all of the seals 40-1, 40-2, . . . 40-*n* as the passageways between each pair 40-1, 40-2; 40-2-40-3; . . . 40-(*n*−1), 40-*n* of seals tend to fill with the flushing medium. Additionally, if a solvent for the coating material is chosen as the flushing medium, migration of some of the flushing medium on down the shaft 38 into the inlet port 50, coating material pumping chamber 54-1, 54-2 or outlet port 41** and thus into the coating material can be tolerated.

A similar seal system 40' including a stack of multiple such seals 40'-1, 40'-2, . . . **40'-*m* can be provided between shaft 38 and the drive motor 36 end of the pump 24 housing to reduce the likelihood of discharge of the flushing medium down shaft 38 in that direction and out of the pump 24 housing. Illustrative cup seals 40-1, 40-2, . . . 40-*n*, 40'-1, 40'-2, . . . 40'-*m*** are the part FSC-50A-16MS-SP23 seals available from Bal Seal Engineering Inc., 19650 Pauling, Foothill Ranch, Calif. 92610-2610 or the part 18-790040041-1 seals available from Parker Hannifin Corp., 6035 Parkland Boulevard, Cleveland, Ohio 44124.

Figure 5:
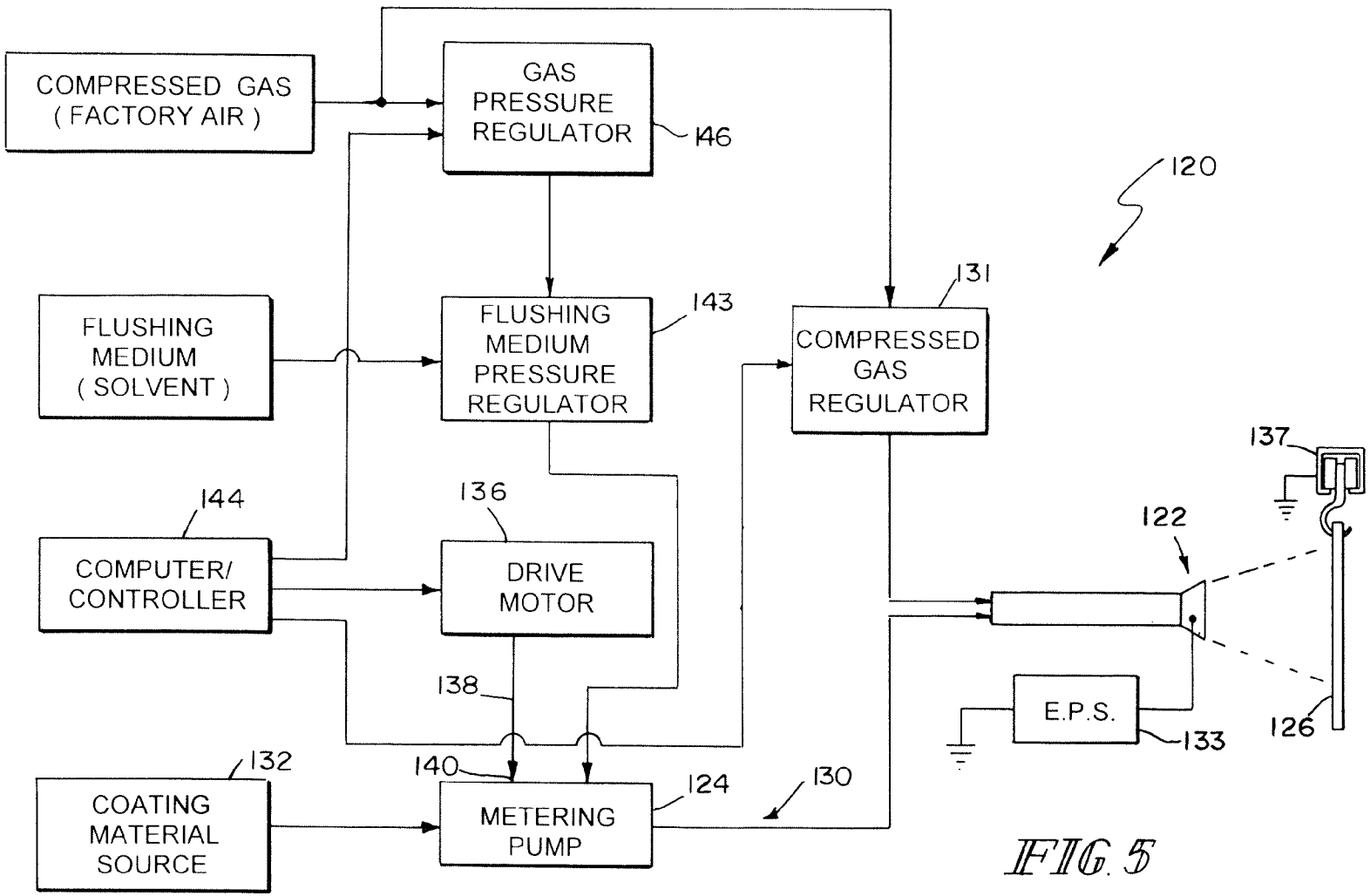
FIG. 5 illustrates diagrammatically another coating material dispensing, atomizing and coating operation; and, FIG. 6 illustrates diagrammatically another coating material dispensing, atomizing and coating operation.

Referring to FIG. 5, another liquid coating system 120 comprises an atomizer 122 of any of the known types and a supply pump 124. Again, while the illustrated atomizer 122 atomizes and dispenses electrostatically charged coating material particles to coat a target 126, it should be understood that the atomization and dispensing can either be electrostatically aided or not. The coating material is transported through an intervening fluid circuit 130 from a source 132 of coating material to the dispensing device 122, for example, by pressurizing the source 132, by gravity, and by mechanically pumping/metering the coating material in the circuit 130 by a gear pump 124 inserted at a convenient point in the circuit 130.

The coating material is delivered to the atomizer 122 where the coating material is atomized into a cloud, the cloud is shaped and directed toward the target 126 by a flow of compressed gas (for example, air) from a compressed gas source 131, and/or by electrostatically charging the coating material during atomization from a source 133 of electrostatic potential, and maintaining the target 126 at or near ground potential (as by maintaining a conveyor 137 by which the target 126 is conveyed past the atomizer 122 at or near ground potential and maintaining low electrical resistance between the target 126 and the conveyor 137.

Again, pump 124 can be driven by a pneumatic or electric motor 136 that requires passage of, for example, a pump drive shaft 138 or operating rod into the fluid path. The motor 136 may rotate or be a linear motor, such as, for example, a diaphragm-type pump. The passage of the pump drive shaft 138, operating rod or the like into the fluid path needs to be sealed 140 to permit the circuit 130 including pump 124 to be pressurized and to permit operation of the pump 124 without leakage of the coating material from the circuit 130.

Filling the seal system of pump 124 with clean flushing medium permits the flushing medium to be pressurized approximately to match the pressure of the coating material being sealed, protecting the seal systems of pump 124 somewhat against pressure differential-related failure of the seal systems of pump 124. The pressure of the clean flushing medium supplied to pump 124 can be controlled from a computer/controller 144 working through compressed gas (typically factory air) pressure regulator 146 controlling a solvent pressure regulator 143 of known type.

Figure 6:
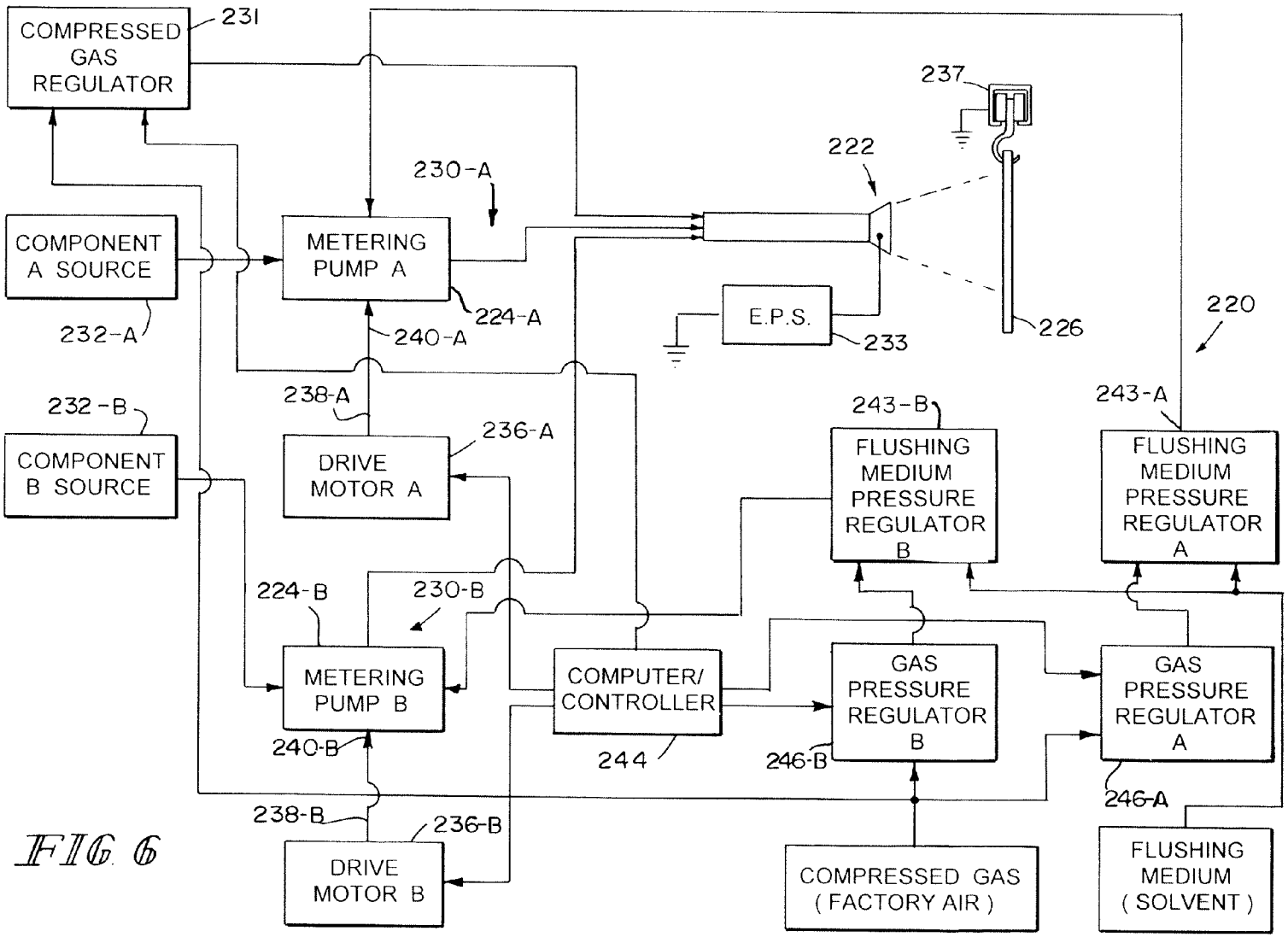

Referring to FIG. 6, another liquid coating system 220 comprises an atomizer 222 of any of the known types. In this embodiment, a plural component coating material comprising components A and B is being dispensed. Gear pumps 224-A and 224-B insure delivery of appropriate ratios of the plural components to the atomizer 222. Again, while the atomizer 222 is illustrated as atomizing and dispensing electrostatically charged coating material particles to coat a target 226, the atomization and dispensing can either be electrostatically aided or not. The A and B components of the coating materials are transported through intervening fluid circuits 230-A and 230-B from respective sources 232-A and 232-B of the A and B components to the dispensing device 222, for example, by pressurizing the sources 232-A and 232-B, by gravity, and by mechanically pumping/metering the coating material in the circuits 230-A and 230-B by gear pumps 224-A and 224-B, inserted at convenient points in the respective circuits 230-A and 230-B.

The A and B components are delivered to the atomizer 222 where they are mixed and the thus-formed coating material is atomized into a cloud, the cloud is shaped and directed toward the target by a flow of compressed gas (for example, air) from a compressed gas source 231, and/or by electrostatically charging the coating material during atomization from a source 233 of electrostatic potential, and maintaining the target 226 at or near ground potential, for example, by maintaining a conveyor 237 by which the target 226 is conveyed past the atomizer 222 at or near ground potential and maintaining low electrical resistance between the target 226 and the conveyor 237.

Typically, gear pumps 224-A and 224-B can be driven by a common, or separate pneumatic or electric motors 236-A and

236-B, separate motors being illustrated in this embodiment. Gear pumps 224-A and 224-B require passage of respective pump drive shafts 238-A, 238-B, operating rods, or the like into the fluid path. The motors 236-A and 236B may rotate or be linear motors, such as, for example, diaphragm-type pump, or may be a combination of these. The passage of the pump drive shafts 238-A, 238-B, operating rods or the like into the fluid path need to be sealed 240-A, 240-B, to permit the respective circuits 230-A, 230-B including pumps 224-A, 224-B to be pressurized and to permit operation of the pumps 224-A, 224-B without leakage of the coating material from the respective circuits 230-A, 230-B.

Filling the seal systems of pumps 224-A, 224-B with clean flushing medium permits the flushing medium to be pressurized approximately to match the pressure of the coating material being sealed, protecting the seal systems of pumps 224-A, 224-B somewhat against pressure differential-related failure of the seal systems of pumps 224-A, 224-B. The pressure of the clean flushing medium supplied to the systems of pumps 224-A, 224-B can be controlled from computer/controller 244 working through compressed gas (typically factory air) pressure regulators 246-A, 246-B controlling solvent pressure regulators 243-A and 243-B, respectively, of known type.

What is claimed is:

1. A pump adapted for coupling in a first fluid circuit between a source of coating material and a dispensing device, the pump including an operating member which extends through a pump housing and adjacent the first fluid circuit, the operating member passing adjacent the first fluid circuit, the passage of the operating member adjacent the first fluid circuit including a seal system to permit operation of the pump while reducing the likelihood of leakage of the coating material from the first fluid circuit out of the housing along the operating member, the seal system including at least first and second seals defining between them a seal chamber facing a pump chamber containing the coating material being pumped, and a second fluid circuit through which a fluid medium is provided under pressure to the seal chamber, the first seal including a rearward face and the second seal including opposed lips defining between them a groove, the lips of the second seal and the rearward face of the first seal defining between them the seal chamber, a first lip of the second seal being sufficiently flexible to permit the fluid medium to be introduced past the first lip of the second seal into the seal chamber.

2. The apparatus of claim 1 further including a motor coupled to the operating member for operating the pump.

3. The apparatus of claim 2 wherein the motor comprises a rotary output shaft.

4. The apparatus of claim 1 wherein the fluid medium comprises a flushing medium for the coating material.

5. The apparatus of claim 4 wherein the flushing medium comprises a solvent for the coating material.

6. A coating material dispensing apparatus including a source of coating material and a dispensing device, a pump coupled in a first fluid circuit between the source of coating material and the dispensing device, the pump including a pump housing, an operating member which extends through the pump housing to a location adjacent the first fluid circuit, the operating member passing adjacent the first fluid circuit, the passage of the operating member adjacent the first fluid circuit including a seal system to permit operation of the pump while reducing the likelihood of leakage of the coating material from the first fluid circuit out of the housing along the operating member, the seal system including at least first and second seals defining between them a seal chamber facing a pump chamber containing the coating material being pumped, and a second fluid circuit through which a fluid medium is provided under pressure to the seal chamber, the first seal including a rearward face and the second seal including opposed lips defining between them a groove, the lips of the second seal and the rearward face of the first seal defining between them the seal chamber, a first lip of the second seal being sufficiently flexible to permit the fluid medium to be introduced past the first lip of the second seal into the seal chamber.

7. The apparatus of claim 6 further including a motor coupled to the operating member for operating the pump.

8. The apparatus of claim 7 wherein the motor comprises a rotary electric motor.

9. The apparatus of claim 6 wherein the fluid medium comprises a flushing medium for the coating material.

10. The apparatus of claim 9 wherein the flushing medium comprises a solvent for the coating material.

* * * * *